United States Patent [19]

Weiler

[11] 3,999,515

[45] Dec. 28, 1976

[54] SELF-SPACING MICROFIELD DONORS

[75] Inventor: Ernest A. H. Weiler, Rochester, N.Y.

[73] Assignee: Xerox Corporation, Stamford, Conn.

[22] Filed: Feb. 3, 1975

[21] Appl. No.: 546,588

[52] U.S. Cl. ..... 118/651

[51] Int. Cl.[2] ..... G03G 15/08

[58] Field of Search ..... 118/637; 427/21; 355/3 DD

[56] References Cited

UNITED STATES PATENTS

| | | | |
|---|---|---|---|
| 3,233,587 | 2/1966 | Morton | 118/637 |
| 3,276,896 | 10/1966 | Fisher | 118/637 |
| 3,292,572 | 12/1966 | Brenneisen et al. | 118/1 |
| 3,667,428 | 6/1972 | Smith | 118/637 |
| 3,672,326 | 6/1972 | Schulze | 118/8 |
| 3,676,215 | 7/1972 | Gundlach | 117/230 |
| 3,759,222 | 9/1973 | Maksymiak et al. | 118/637 |
| 3,881,927 | 5/1975 | Fantuzzo | 118/637 |
| 3,906,897 | 9/1975 | Davidson | 118/637 |

*Primary Examiner*—Mervin Stein
*Assistant Examiner*—Douglas Salser
*Attorney, Agent, or Firm*—James J. Ralabate; Clarence A. Green; William A. Henry, II

[57] ABSTRACT

Microfield donors used in a xerographic process in which the donor is spaced from the photoconductive surface by a spacer element along their interracting surfaces to preclude background deposits of toner from forming in the development of an electrostatic latent image on the photoconductive surface.

19 Claims, 8 Drawing Figures

Fig. 4.
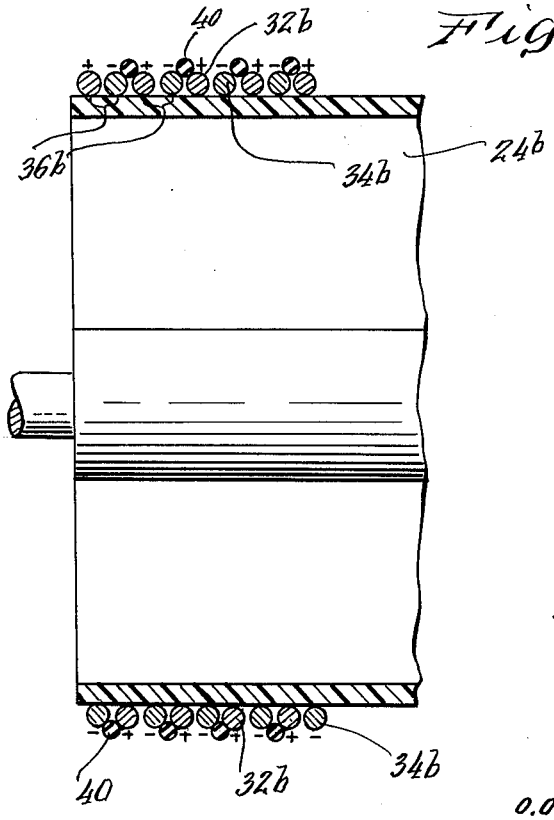
Fig. 5.
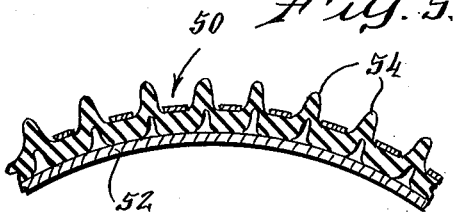
Fig. 6.
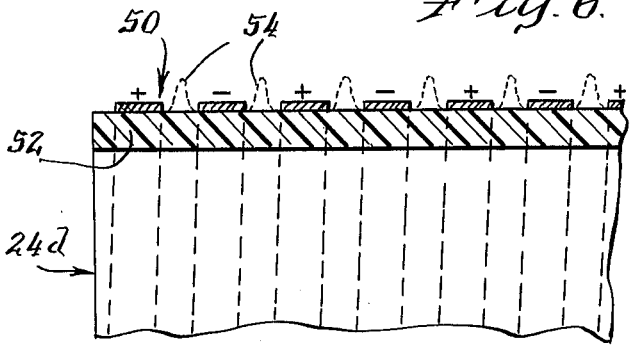
Fig. 7.
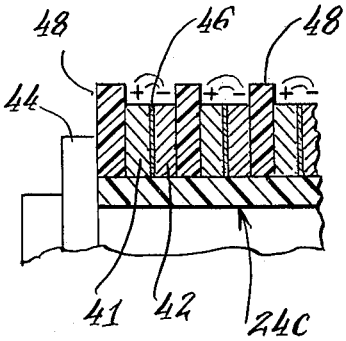
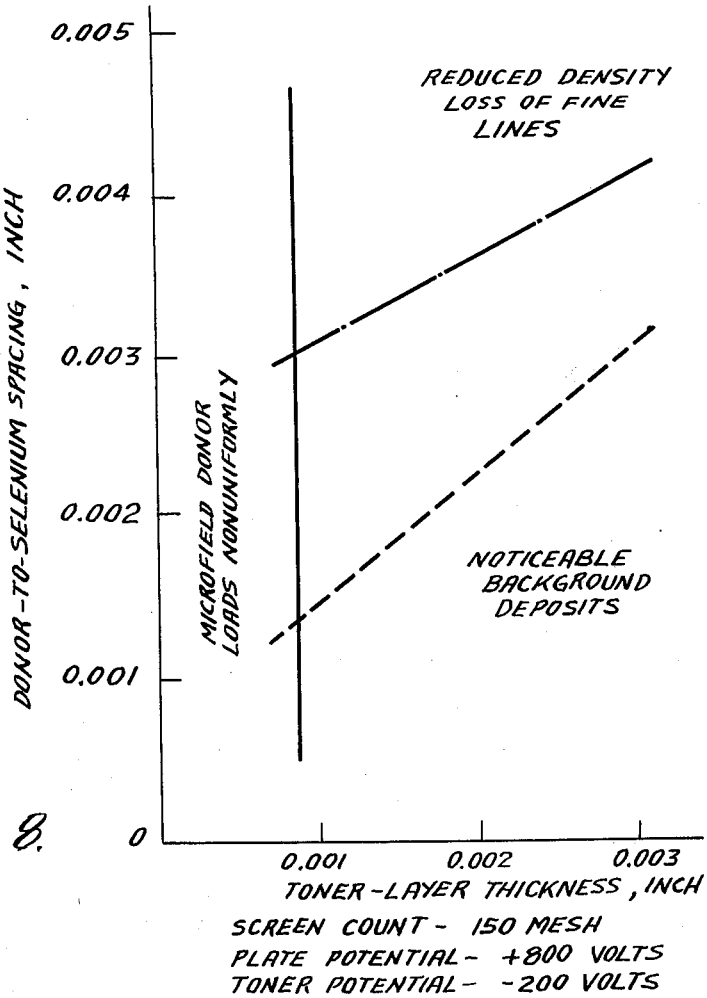
Fig. 8.

SELF-SPACING MICROFIELD DONORS

BACKGROUND OF THE INVENTION

Field of Invention:

This invention relates to xerography and more particularly to an improved apparatus for the development of an electrostatic image in which a toner layer is presented to a latent image for its development.

Description of Prior Art:

In the xerographic reproduction process, a photoconductive surface is charged and then exposed to a light pattern of the information to be reproduced, thereby forming an electrostatic latent image on the photoconductive surface. Toner particles, which may be finely divided, pigmentd, resinous material are presented to the latent image where they are attracted to the photoconductive surface. The toner image can be fixed and made permanent on the photoconductive surface or it can be transferred to another surface where it is fixed.

One known method of developing latent electrostatic images is by a process called transfer development. Transfer development broadly involves bringing a layer of toner to an imaged photoconductor where toner particles are transferred from the layer to the imaged areas. In one transfer development technique, the layer of toner particles is applied to a donor member which is capable of retaining the particles on its surface and then the donor member is brought into close proximity to the surface of the photoconductor. In the closely spaced position, particles of toner in the toner layer on the donor member are attracted to the photoconductor by the electrostatic charge on the photoconductor so that development takes place. In this technique the toner particles must traverse an air gap to reach the imaged regions of the photoconductor. In two other transfer techniques the toner-laden donor actually contacts the image photoreceptor and no air gap is involved. In one such technique the toner-laden donor is rolled in non-slip relationship into and out of contact with the electrostatic latent image to develop the image in the single rapid step. In another such technique, the toner-laden donor is skidded across the xerographic surface. Skidding the toner by as much as the width of the thinnest line will double the amount of toner available for development of a line which is perpendicular to the skid direction, and the amount of skidding can be increased to achieve greater density or greater area coverage.

It is to be noted, therefore, that the term "transfer development" is generic to development techniques where (1) the toner layer is out of contact with the imaged photoconductor and the toner particles must traverse an air gap to effect development (2) the toner layer is brought into rolling contact with the imaged photoconductor to effect development, and (3) the toner layer is brought into contact with the imaged photoconductor and skidded across the imaged surface to effect development. Transfer development has also come to be known as "touchdown development".

In a typical transfer development system, a cylindrical or endless donor member is rotated so that its surface can be presented to the moving surface of a photoconductive drum bearing an electrostatic latent image thereon. Positioned about the periphery of the donor member are a number of processing stations including a donor loading station, at which toner is retained on the donor member surface; an agglomerate removal station at which toner agglomerates are removed from the toner layer retained on the surface of the donor member; a charging station at which a uniform charge is placed on the particles of the toner retained on the donor surface; a clean-up station a which the toner layer is converted into one of uniform thickness and at which any toner agglomerate not removed by the agglomerate removal station are removed; a development station at which the toner particles are presented to the imaged photoconductor for image development; and a cleaning station at which a neutralizing charge is placed upon the residual toner particles and at which a cleaning member removes residual toner from the peripheral surface of the donor. In this manner, a more or less continuous development process is carried out.

Among the typical donor members employed in the process heretofore was a metal cylinder covered with an insulating enamel upon which was coated a metal electrode in a gravure-screen pattern. A potential of up to 300 volts is impressed between the electrode and cylinder while the cylinder is rotated in a vibrating tray of toner powder. In a mass of toner that appears to be electrically neutral there will be a roughly equal amounts of positively and negatively charged particles. Microsized electrostatic fields formed between the electrode and the cylinder cause toner of one polarity to deposit on the electrode and toner of the opposite polarity to deposit on the squares in the electrode. Clumps of excess toner are vacuumed off and the remaining uniformly thick toner layer is corona charged to make it all the same polarity, thus making the donor ready for use in developing an image.

As discussed previously the latent image on a photoconductive surface could be developed by mementarily "touching down" the donor member to the surface. The surface of the photoconductor containing the latent image is charged at a greater potential than the donor surface. Therefore, in charged areas of the surface, toner is attracted from the donor to the surface; in uncharged areas the toner-charge image forces keep the toner particles attracted to the donor, and the surface remains free of toner particles. However, it was found that several such "touchdowns" were needed to produce highly density images because of a sparse migration of toner particles from the donor to the photoconductive surface.

Thicker coatings of toner produced by various techniques were explored in attempts to obtain the density desired with one "touchdown", but these all seemed subject to the difficulty that where the thick coating of toner touched uncharged areas of the photoconductor surface, some surface toner particles less strongly attracted to the donor transferred to the photoconductor producing an objectionable background deposit. The obvious solution was to bring the donor only very close to the photoconductor but not into contact with it. Toner will jump across a narrow air gap to charged areas of a xerographic photoconductor surface, but not to uncharged areas. The images thus obtained were greatly improved. This latter process has been termed "spaced touchdown".

Developing across an air gap between the donor and the photoreceptor made it possible to produce background free images from heavily loaded donors. The gap was maintained by spacers at the ends of the rigid cylindrical donors and photoreceptors. However, it was soon determined that the gap spacing was critical dependent upon the toner loading characteristics of the donor.

With the typical donor member previously described, development can be carried out by rolling the donor cylinder in near contact with a charged and exposed xerographic photoconductive plate or drum. Spacing shims between the donor and photoreceptor, at the ends of the donor cylinder where there is not toner, maintain a space of about 0.001 to 0.002 inch between the surface of the toner and the surface of the photoconductor. During development a bias potential is applied to the photoconductor backing to compensate for any residual potential in background areas. If the bias potential is just equal in magnitude but opposite in polarity to the potential on the photoconductor in fully exposed areas, a good image will be produced, but some deposition of toner occurs in background areas. Such deposition of toner can be suppressed almost completely by increasing the bias potential to about 50 volts more than the background potential of the photoconductor. Thus, if the potential on the photoconductor in fully exposed areas is +100 volts, approximately −150 volts should be applied to the photoconductor backing. In the development step, spacing must be precisely controlled, and the voltage relationships between photoconductor and donor must be adjusted carefully to minimize background deposits without degrading fine line detail or lighter halftone tints.

The interrelationships between the various aspects of image quality and toner-layer thickness, toner charge levels, and spacing between donor and photoconductor can be summarized in domain plots of the type illustrated in FIG. 8, which applies for toner layers charged to potentials of about −200 volts. Generally acceptable images will be produced under the conditions indicated, for the central area between the two lines. As the donor-to-selenium (or photoconductor surface) spacing is reduced, background deposits will appear and become unacceptable. As the spacing is increased, image density drops and the ability of the process to reproduce fine lines and dots is reduced. Attempts to operate with toner layer thicknesses much less than 0.001 inch produce unsatisfactory images because the donor loading is generally not sufficiently uniform for such thin layers. In general, a donor to photoconductor surface spacing of between 0.001 to 0.010 inches, depending upon toner layer thickness can be used with acceptable results.

A microfield donor used in a "spaced touchdown" process can therefore produce good, high density images that do not have several of the defects commonly associated with images produced by toner-carrier developers. Although the processing steps are simple, there is a need to maintain accurate spacings to produce uniformly good images.

SUMMARY OF INVENTION

In accordance with this invention, a new type of microfield donor is proposed for use in "spaced touchdown development" of electrostatic images on a photoconductor surface. The donor member can take a variety of forms, although all of the forms are provided with the common feature of having an element to automatically regulate the spacing between th donor and photoconductor surfaces at the developing station in the xerographic process, and means to establish a plurality of electrostatic microfields on the donor surface to attract and hold toner particles to the donor so they can be transported to the developing station. Additionally, certain ones of said donors can automatically adjust to any unevenness in the photoconductive surface to maintain the required spacing between the donor and photoreceptor.

In one form of the invention the donor element is a conductive cylinder connected to a reference electrical potential. A pair of conductive filaments are wound about the circumference of the drum in between each other. Each of the conductive filaments are connected to a source of electrical potential of opposite polarity so that microfields are established between each adjacent pair of filament windings.

If desired, the polarity of the conductive filaments can be reversed through commutator contact to agitate the toner particles for the purposes disclosed in my co-pending application entitled "Microfield Donor With Toner Agitation," filed concurrently herewith on Feb. 3, 1975 which was given Ser. No. 546,589.

Briefly, as the cylinder rotates each conductive filament will be pulsed from a positive potential to a negative potential and then back to a positive potential. Both positive and negative triboelectrically charged toner particles will be picked up by the cylinder from a vibrating tray. Because of the rapid change of potential induced on the donor electrodes, the toner will be constantly repelled and attracted from the filaments along the circumference of the cylinder and will be brought into a constant jumping motion along the electrostatic field lines of the donor microfield. When a toner particle comes within the reach of an electrostatic flux line emanating from the image charge on the photoconductive surface at the developing station, it is repelled by the constantly alternating field induced in the donor filaments so it can home in on the field line of the photoconductive surface and thus develop the latent image. In other words, by constantly having the toner agitated or vibrated in the microfield, the electrostatic attraction of the toner particles to the donor is nullified at some point when the donor drum is adjacent to the photoconductor surface and by thus nullifying the electrostatic attraction of toner to donor, the toner may be more readily attracted by the charge induced in the photoconductor surface, without any great increase in potential of the photoconductor surface over the electrostatic charge induced by the microfield of the donor.

Furthermore, by inducing a constant attraction and repulsion of the toner particles to the microfield donor a more uniform distribution of the toner particles along the surface of the microfield donor cylinder is obtained. Otherwise, the toner particles tend to agglomerate and be deposited on the surface of the donor and protrude well above the mean thickness of the toner. If some provision is not made for controlling the thickness of the toner layer carried by the donor, thicker regions of the toner layer will be compacted between the donor surface and the surface of the photoconductive layer in the development zone, also producing agglomerates. This build-up of toner in certain areas may result in the deposit of toner on background areas on the photoconductive surface, even in "spaced touchdown" where the cylinder is spaced from the photoconductive surface.

Further, because of the constant agitation of the toner induced by the alternate field of the microfield donor about its circumference, high density images are assured on the photoconductive surface. Substantially none of the toner is adhered to the donor, but rather floats adjacent to the donor surface. As a consequence, substantially all of the toner coming into close proximity with the photoconductive surface will be attracted to the electrostatic charge on the latent image on that surface. And as mentioned above, this dispersal is uniform because of the preclusion of the agglomeration of toner particles in selected areas of the donor.

In addition to the conductive filament windings on the donor cylinder, a non-conductive filament of a larger diameter is wound about the circumference of the donor in contact with the cylinder surface between each pair of conductive filament windings establishing a microfield. The diameter of the non-conductive filament is selected so as to maintain and regulate a predetermined gap between the photoconductive surface and donor cylinder. This spacing can be determined in accordance with a domain plot such as shown in FIG. 8.

Alternatively, a non-conductive filament of predetermined diameter can be wound radially or in a helix configuration about the donor cylinder and seated on adjacent pairs of the conductive filament windings establishing the microfields.

In lieu of filaments, the microfield donor cylinder itself can be formed from a pair of electrically isolated conductive coil springs compressed in an axial direction with their coils in between each other and mounted between endbells. The endbells are connected to a source of reference electrical potential such as ground, while each coil spring is connected to a source of negative and positive potential, respectively, to establish a plurality of microfields between adjacent coils. Through commutator contact, the polarity of the coils can be constantly reversed to establish alternating or pulsed microfields for toner agitation as described above. A third dielectric coil spring of larger diameter is then located between the coils of each adjacent pair of coils establishing the microfields to provide the requisite spacing of the donor and photoconductive surfaces. The advantage of this construction is that the donor cylinder, being flexible, can adjust automatically to any unevenness on the photoconductor surface onto which the spacer spring comes into contact.

Flexibility of the donor drum can also be obtained by using a thin, pneumatically pressurized rubber drum having a cylindrical surface. A conductive screen pattern can be silk-screened or deposited on the drum surface and in conjunction with a conductive metal layer within the interior of the dielectric rubber drum establish a plurality of electrostatic microfields. Spacers in the form of a gridwork of flexible protrusions molded on the rubber drum and extending outwardly from the drum surface between the elements of the conductive screen can be used to regulate and maintain the gap with the photoconductive surface.

Further advantages of objects of the invention will become more apparent from the following specification and claims, and from the accompanying drawings wherein:

BRIEF DESCRIPTION OF THE DRAWINGS

FIG. 4 is a longitudinal sectional view of a portion of another embodiment of a self-spacing microfield donor construction in accordance with the present invention;

FIG. 5 is an enlarged transverse sectional view of a portion of an embodiment of a flexible self-spacing microfield construction in accordance with the present invention;

FIG. 6 is an enlarged longitudinal sectional view of the flexible, self-spacing microfield donor construction of FIG. 5;

FIG. 7 is an enlarged longitudinal sectional view of a portion of still another embodiment of a flexible self-spacing microfield donor construction in accordance with the present invention; and FIG. 8 illustrates a typical domain plot for determining the proper donor to photoreceptor gap required so as to be able to select a spacer element of predetermined size for a microfield donor construction.

DETAILED DESCRIPTION OF PREFERRED EMBODIMENTS

The present invention relates to a transfer development xerographic apparatus in which toner particles are applied to an electrostatic latent image on a photoconductive surface to develop the image. Although the apparatus is described herein as part of a xerographic copier, it can be utilized in conjunction with any reproduction system wherein a latent image is to be developed by applying toner thereto.

Figure 1:
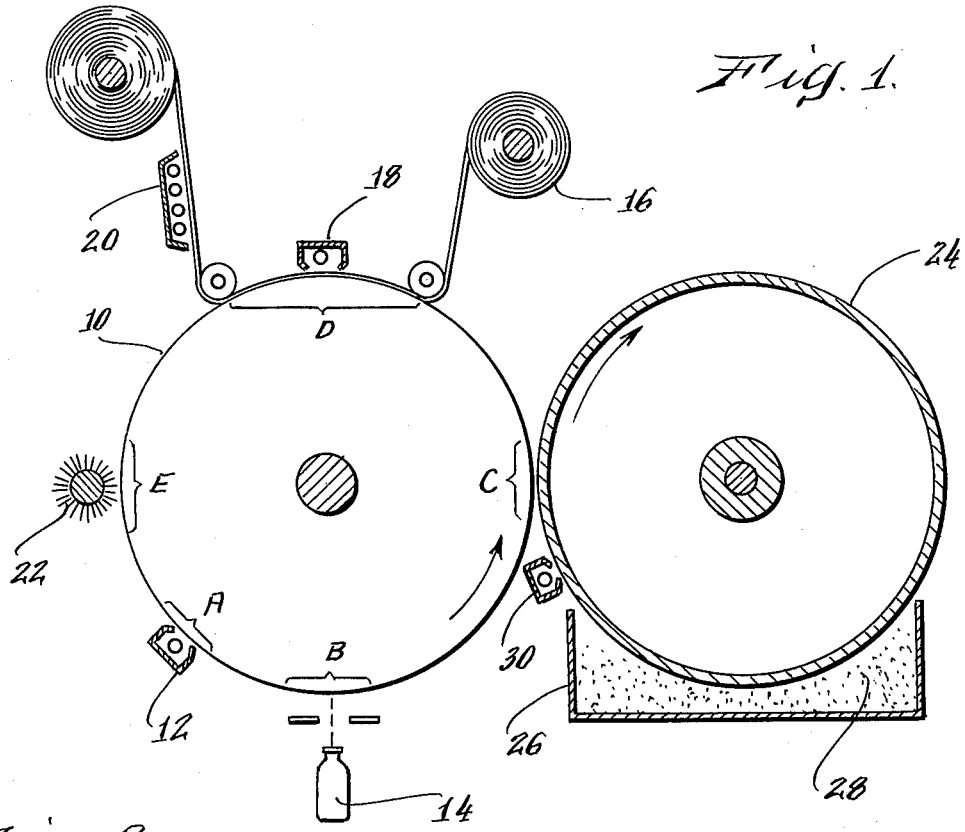
FIG. 1 is a sectional diagrammatic view of the xerographic apparatus in accordance with the present invention.

Referring now to the drawings wherein like numerals indicate like elements throughout the several views, and more particularly to FIG. 1, there is shown a xerographic reproduction apparatus utilizing the concept of the present invention. In this apparatus a xerographic plate in the form of a cylindrical drum 10 passes through stations A – E in the direction shown by the arrow. The drum has a suitable photosensitive surface, such as one including selenium overlying a layer of conductive material, on which a latent electrostatic image can be formed. The various stations about the periphery of the drum which carry out the reproduction process are: charging station A, exposing station B, developing station C, transfer station D, and cleaning station E. Stations A, B, D and E represent conventional means for carrying out their respective functions. Apart from their association with the novel arrangement to be described with respect to station C they form no part of the present invention.

At station A, a suitable charging means 12, e.g., a corotron, places a uniform electrostatic charge on the photoconductive material. As the drum rotates, a light pattern, via a suitable exposing apparatus 14, e.g., a projector, is exposed onto the charged surface of drum 10. The latent image thereby formed on the surface of the drum is developed or made visible by the application of a finely divided pigmented, resinous powder called toner, at developing station C, which is described in greater detail below. After the drum is developed at station C, it passes through transfer station D comprising a copy sheet 16, corona charging device 18 and fusing device 20. Following transfer and fixing of the developed image to the copy sheet, the drum rotates through cleaning station E, comprising cleaning device 22, e.g., a rotating brush, at which residual toner is removed.

At developing station C, the apparatus includes a donor member 24 (more particularly described below) rotatably mounted adjacent a toner reservoir 26, containing a supply of toner particles 28. The donor member 24 is positioned so that a portion of its periphery comes into contact with toner particles 28. The donor member is also located so as to provide a small gap between the surface of drum 10 and the outer surface of a toner layer carried by donor roll 24. As toner particles are presented to the electrostatic imaged regions of drum 10, the particles traverse this small gap thereby developing the latent image.

Located between toner reservoir 26 and the development zone is a charging means 30, such as a corona charging device, which is adapted to place a uniform charge on the toner particles of a polarity opposite to the polarity of the latent image on the photoconductive drum 10.

Figure 2:
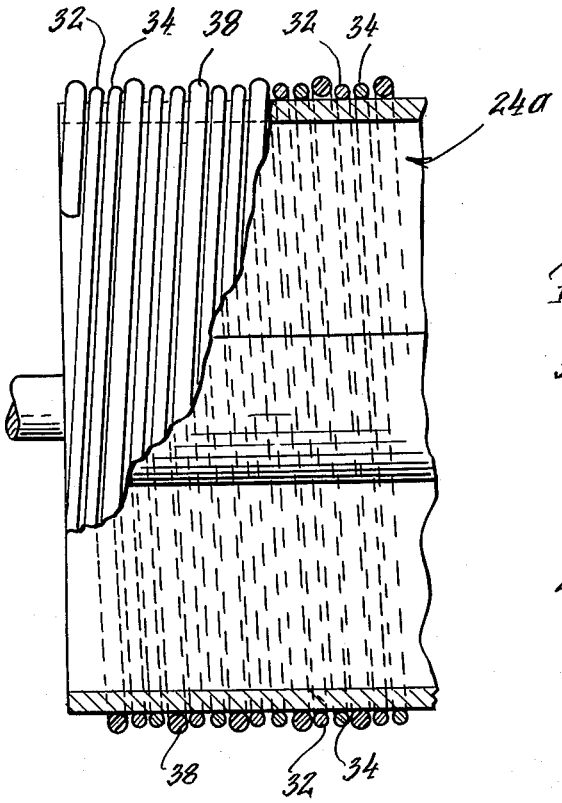
FIG. 2 is a longitudinal sectional view of a portion of one embodiment of a self-spacing microfield donor construction in accordance with the present invention.

The construction of microfield donor 24, which carries the toner particles 28 to developing station C, comprises the subject of the instant invention. One form of particular donor structure which is suitable to carry-out the concepts of the invention is illustrated in FIGS. 2 and 3.

Donor element 24 comprises a metallic cylindrical drum 24*a*. Drum 24*a* is biased to a ground reference potential by its close proximity to toner reservoir 28 and/or the adjacent photoreceptor drum 10. A pair of conductive filaments 32 and 34 are wound about the circumference of drum 24*a* in between each other. Each of the conductive filaments 32 and 34 are connected to a source of electrical potential of opposite polarity (not shown) so that electrostatic microfields are established between each adjacent pair of filament windings such as indicated at 36. If desired, the polarity of the conductive filaments 32 and 34 can be periodically reversed through commutative contact to agitate the toner particles to preclude the formation of agglomerates on the surface of the donor drum 24*a* and to effect nullification of the electrostatic attraction of the triboelectrically charged toner particles to the surface of drum 24*a* as the particles approach the developing station C.

Figure 3:
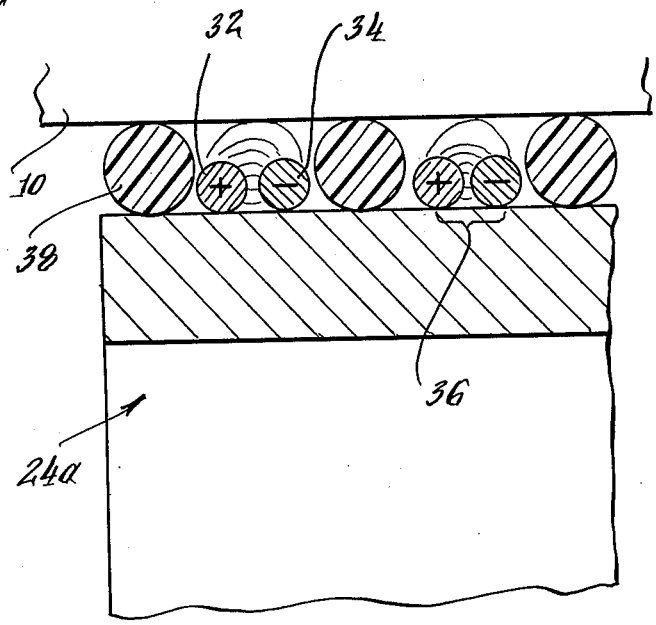
FIG. 3 is an enlarged detailed view of the microfield donor section illustrated in FIG. 2.

In addition to the conductive filament windings 32, 34 on the donor cylinder 24*a*, a non-conductive filament 38 of a larger diameter is wound about the circumference of the doner drum 24*a* in contact with the drum surface between each pair of conductive filament windings 36 establishing a microfield, as clearly illustrated in FIG. 3. The diameter of the non-conductive filament 38 is selected so as to maintain and regulate a predetermined gap between the photoconductive surface of drum 10 and the donor cylinder 24*a*. This spacing can be determined in accordance with a domain plot such as shown in FIG. 8.

Alternatively, as illustrated in FIG. 4, a nonconductive filament 40 of predetermined diameter can be wound radially or in a helix configuration about a similar donor cylinder 24*b* and seated on adjacent pairs 36*b* of the conductive filament windings 32*b*, 34*b* establishing the microfields.

In lieu of filaments, a microfield donor cylinder such as indicated at 24*c* in FIG. 7 can be formed from a pair of electrically isolated conductive coil springs compressed in an axial direction with their coils 41 and 42 in between each other and mounted between endbells 44. The coils 41 and 42 of the compressed springs can be coated with a dielectric 46 along their facing surfaces to electrically isolate them from each other.

The endbells 44 are connected to a source of electrical reference potential such as ground and each coil spring 41, 42 is connected to a source of positive and negative potential, respectively, to establish a plurality of microfields between adjacent coils. Through commutator contact, the polarity of the coils can be constantly reversed to establish alternating or pulsed microfields for toner agitation.

A third coil spring of dielectric material and of a larger diameter has its coils 48 located between the coils of each adjacent pair of coils 41, 42 establishing the microfields to provide for appropriate spacing of the donor 24*c* from the photoreceptor drum 10 at the development station C. The advantage of such a construction is that the donor cylinder 24*c*, being flexible, can adjust automatically to any unevenness in the protoconductive surface of photoreceptor 10 which the spacer coils 48 contact at station C.

Flexibility of the donor drum can also be attained by using a thin pneumatically pressured rubber drum 24*d*, as shown in FIGS. 5 and 6, which has a cylindrical surface. A conductive screen pattern 50 can be silk-screened or deposited on the drum surface and in conjunction with a conductive metal layer 52 within the interior of the dielectric rubber drum 24*d* establish plurality of electrostatic microfields. Spacers in the form of a gridwork of flexible protrusions 54 molded on the rubber drum 24*d* and extending outwardly from the drum surface between the conductive elements of screen 50 can be used to regulate and maintain the gap of drum 24*d* with the photoreceptor drum 10 at development station C.

With the spacing elements as described above, each of the microfield donors 24*a* – 24*d* can be used in a "spaced touchdown" xerographic process and will produce good high density images. Because of the maintenance and regulation of the gap between the donor and the photoreceptor at the developing station C, unacceptable background deposits will be eliminated.

What is claimed is:

1. A xerographic microfield donor member adapted to transport triboelectrically charged toner particles to a latent electrostatic image on the surface of a xerographic photoconductor spaced from said donor for development of said latent image, said donor member comprising an endless electrically conductive support member including means for establishing a plurality of electrostatic microfields on the surface of said support member to attract and hold toner particles to said support member and spacing means on the surface of said support member for regulating and maintaining the space between said donor and photoconductor along their interacting surfaces.

2. A xerographic microfield donor in accordance with claim 1 wherein said endless electrically conductive support member is a cylindrical drum, and said last named means includes a non-conductive filament wound about the circumference of said cylindrical drum.

3. A xerographic microfield donor in accordance with claim 1 wherein said endless electrically conductive support member is a cylindrical drum biased with an electrical reference potential, and said means establishing said microfields including a pair of conductive filaments wound about the circumference of said drum in between each other, each of said conductive filaments being connected to a source of electrical potential, and said sources of electrical potential being of opposite polarity so that microfields for attracting said toner particles are established between each adjacent pair of filament windings on the circumference of said drum.

4. A xerographic microfield donor in accordance with claim 3 wherein said means for maintaining and regulating the space between said donor and photoconductor surface includes a non-conductive filament wound about the circumference of said cylindrical drum between each adjacent pair of conductive filament windings establishing said microfields.

5. A xerographic microfield donor in accordance with claim 4 wherein said non-conductive filament is of a larger diameter than said conductive filaments and is in contact with the surface of said cylindrical drum between each adjacent pair of conductive filament windings establishing said microfields.

6. A xerographic microfield donor in accordance with claim 4 wherein said non-conductive filament is seated on adjacent pairs of conductive filament windings establishing said microfields.

7. A xerographic microfield donor in accordance with claim 1 wherein said endless electrically conductive support member has a flexible surface to conform to slight changes in evenness of said photoconductor surface.

8. A xerographic microfield donor in accordance with claim 7 wherein said endless electrically conductive support member is a pneumatically pressurized rubber drum having a cylindrical surface.

9. A xerographic microfield donor in accordance with claim 8 wherein said means for regulating and maintaining the space between said donor and photoconductor surface includes a gridwork of flexible protrusions extending outwardly from said drum surface.

10. A xerographic microfield donor in accordance with claim 8 wherein said means for establishing said microfields includes a conductive screen pattern deposited on said flexible cylindrical surface having portions thereof biased with an electrical potential and a conductive layer on the interior of said drum biased to a reference electrical potential, whereby a plurality of microfields can be established on the surface of said drum to attract toner particles thereto.

11. A xerographic microfield donor in accordance with claim 10 wherein said means for regulating and maintaining the space between said donor and photoconductor surface includes a gridwork of flexible protrusions extending outwardly from said drum surface between the elements of said conductive screen.

12. A xerographic microfield donor in accordance with claim 7 wherein said endless electrically conductive support member includes a pair of electrically isolated conductive coil springs compressed in an axial direction with their coils in between each other mounted between endbells.

13. A xerographic microfield donor in accordance with claim 12 wherein said means establishing said microfields includes means for connecting said endbells to a source of electrical reference potential, and means for connecting each of said coil springs to a source of electrical potential, said sources of electrical potential being of opposite polarity so that microfields for attracting said toner particles are established between each adjacent coil of said coil springs.

14. A xerographic microfield donor in accordance with claim 12 wherein said means for regulating and maintaining the space between said donor and photoconductor surface includes a third coil spring of larger diameter than said pair of electrically isolated conductive coil springs having its coils between each adjacent pair of coils establishing said microfields.

15. A xerographic microfield donor in accordance with claim 14 wherein said means establishing said microfields includes means for connecting said endbells to a source of electrical reference potential, and means for connecting each of said first pair of coil springs to a source of electrical potential, said sources of electrical potential being of opposite polarity so that microfields for attracting said toner particles are established between each adjacent coil of said coil springs.

16. In a xerographic apparatus for developing a latent electrostatic image formed on the surface of a xerographic photoconductive plate, means for developing said latent image, said means comprising:

a. a microfield donor member adapted to transport toner particles to said latent image comprising an endless electrically conductive support member including 1. means for establishing a plurality of electrostatic microfields on the surface of said support member to attract and hold toner particles to said support member, b. means to continuously advance said donor member past a plurality of treating stations, said treating stations including:

1. a toner loading station including a supply of toner particles at which toner particles are contacted and a layer of toner particles retained on said donor member in response to the microfields established thereon;

2. a developing station at which said layer of toner particles is presented in developing relation to a latent image on said xerographic photoconductive plate, and c. means on the surface of said support member for regulating and maintaining a space between said donor and photoconductive plate along their interacting surfaces.

17. The apparatus of claim 16 wherein a charging station at a point in advance of said developing station is located between said toner loading station and said developing station and includes a charging means adapted to place a uniform charge on said toner particles retained by said donor member of a polarity opposite to that of said latent image.

18. A xerographic microfilm donor in accordance with claim 1 wherein said spacing means comprises a multiplicity of protrusions extending outwardly from the surface of said support member.

19. A xerographic microfield donor in accordance with claim 18 wherein said protrusions are flexible.

* * * * *